US008234989B2

(12) United States Patent
Thomas et al.

(10) Patent No.: US 8,234,989 B2
(45) Date of Patent: Aug. 7, 2012

(54) QUILTING MACHINE HOPPING FOOT NAVIGATION SYSTEM

(75) Inventors: Janna Lee Thomas, Loveland, CO (US); Paul Roger Thomas, Loveland, CO (US)

(73) Assignee: USAUS, LLC, Loveland, CO (US)

( * ) Notice: Subject to any disclaimer, the term of this patent is extended or adjusted under 35 U.S.C. 154(b) by 181 days.

(21) Appl. No.: 12/590,119

(22) Filed: Nov. 2, 2009

(65) Prior Publication Data

US 2011/0100276 A1 May 5, 2011

(51) Int. Cl.
*D05B 11/00* (2006.01)

(52) U.S. Cl. ..... 112/117

(58) Field of Classification Search ..... 112/114, 112/115, 117, 119, 101, 227, 235, 125, 128, 112/134, 151, 136
See application file for complete search history.

(56) References Cited

U.S. PATENT DOCUMENTS

| | | | | | |
|---|---|---|---|---|---|
| 10,463 | A | * | 1/1854 | Baker | 202/159 |
| 1,623,075 | A | * | 4/1927 | Thomas | 112/470.09 |
| 3,046,918 | A | * | 7/1962 | Hess | 112/470.17 |
| 3,993,009 | A | * | 11/1976 | Osaki | 112/235 |
| 4,008,672 | A | * | 2/1977 | Cianciotti | 112/470.07 |
| 4,899,677 | A | * | 2/1990 | Frey et al. | 112/151 |

* cited by examiner

*Primary Examiner* — Tejash Patel
(74) *Attorney, Agent, or Firm* — Craig R. Miles; CR Miles, P.C.

(57) ABSTRACT

A quilting machine sewing head navigator useful in generating directional travel in the sewing head of a quilting machine in relation to a stitchable material.

7 Claims, 2 Drawing Sheets

QUILTING MACHINE HOPPING FOOT NAVIGATION SYSTEM

I. FIELD OF THE INVENTION

A sewing head navigator useful in generating directional travel in the sewing head of a stitching device in relation to a stitchable material.

II. BACKGROUND OF THE INVENTION

Conventionally, longarm quilting machines come equipped with a sewing machine head (also referred to as a "sewing head"), a worktable, several fabric rollers, and a metal frame. Typically, overall dimensions of a longarm quilting machine can range from about ten to about fourteen feet in length by two-and-a-half to four feet in depth. A stitchable material can be stretched over the worktable for stitchable engagement with the sewing head. The sewing head typically includes a hopping foot which holds down the stitchable material. The hopping foot height can be adjusted up and down to accommodate the thickness of the stitchable material stretched over the worktable. The sewing head further includes a needle drive mechanism which generates sufficient movement in a needle to stitchably engage a thread with the stitchable material. The hopping foot travels over the stitchable material as the needle stitchably engages the thread with the stitchable material to form stitches in a desired stitch pattern. The sewing head can further include a long arm having a configuration which can be hand guided to direct travel of the needle and hopping foot in relation to the stitchable material. Conventional longarm quilting machines may further provide handles coupled to the long arm for grippable engagement by the operator. While there are numerous and varied manufacturers and models of longarm quilting machines, there remain substantial unresolved problems in hand guiding the long arm to generate travel of the hopping foot and needle in relation to the stitchable material.

A first substantial problem in guiding the hopping foot and needle in relation to the stitchable material can be that the mass of the sewing machine head including the mass of the hopping foot, needle drive mechanism, and long arm can gather substantial linear momentum as the operator guides the hopping foot and needle over the stitchable material by forcibly urging the long arm in a particular direction. The linear momentum in the sewing machine head can make change of direction in the hopping foot and needle difficult and accordingly it can be difficult to achieve certain stitched patterns in the stitchable material.

Another substantial problem in guiding the hopping foot and needle in relation to the stichable material can be that conventional placement of the operator's hands on the long arm, or handles coupled to the long arm, can be a substantial distance from the hopping foot and needle which actually stitchably engages the stitchable material. The operator responds to perceptual-motor cues in interaction with the long arm rather than perceptual-motor cues in interaction with the hopper foot and needle. These indirect perceptual-motor cues from the long arm can be difficult to cognitively weigh to achieve desired travel of the hopping foot and needle in relation to the stitchable material.

Another substantial problem in guiding the sewing machine head in relation to the stichable material can be that conventional placement of the operator's hands on the long arm, or handles coupled to the long arm, can make difficult visual perception of the location of the hopping foot and needle in relation to the stitchable material.

The inventive sewing head navigator and inventive methods of using the inventive sewing head navigator addresses each of the foregoing problems associated with conventional sewing head guides and conventional methods of guiding a sewing head.

II. SUMMARY OF THE INVENTION

Accordingly, a broad object of the invention can be to provide a sewing head navigator including a navigator body having a length disposed between a pair of hand grippable ends. The navigator body pivotally couples about the external surface of the hopping foot. Forcible urging upon the hand grippable ends acts to generate travel in the hopping foot and needle over the stitchable material allowing perceptual-motor cues to be taken directly from the hopping foot and needle.

Another broad object of the invention can be to provide a method of using a sewing head navigator pivotally coupled to the hopping foot of a quilting machine to generate travel in a hopping foot and needle of the sewing head in relation to stitchable material producing perceptual-motor cues which requires less cognitive weighing to achieve a desired direction of travel of the hopping foot and needle.

Naturally, further objects of the invention are disclosed throughout other areas of the specification, drawings, photographs, and claims.

III. A BRIEF DESCRIPTION OF THE DRAWINGS

IV. DETAILED DESCRIPTION OF THE PREFERRED EMBODIMENTS

A sewing head navigator useful in generating directional travel in the sewing head of a stitching device in relation to a stitchable material.

Figure 1:
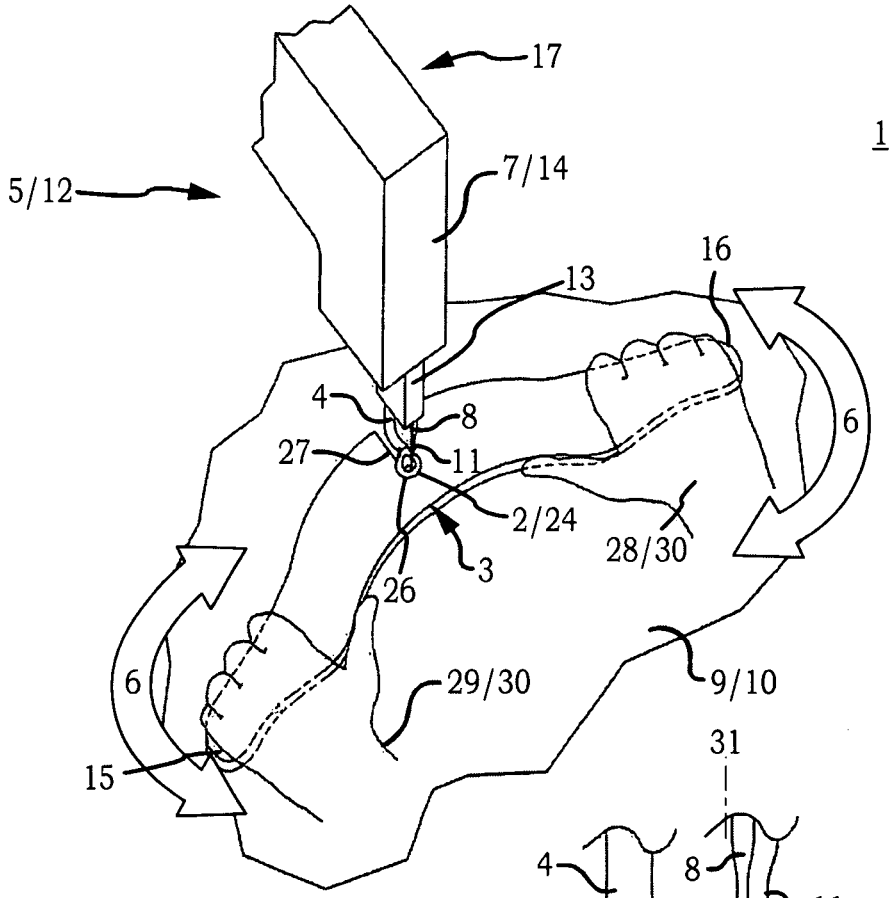
FIG. 1 is a perspective view of a particular embodiment of the inventive sewing head navigator and a particular embodiment of a method of using the inventive sewing head navigator.
Figure 2:
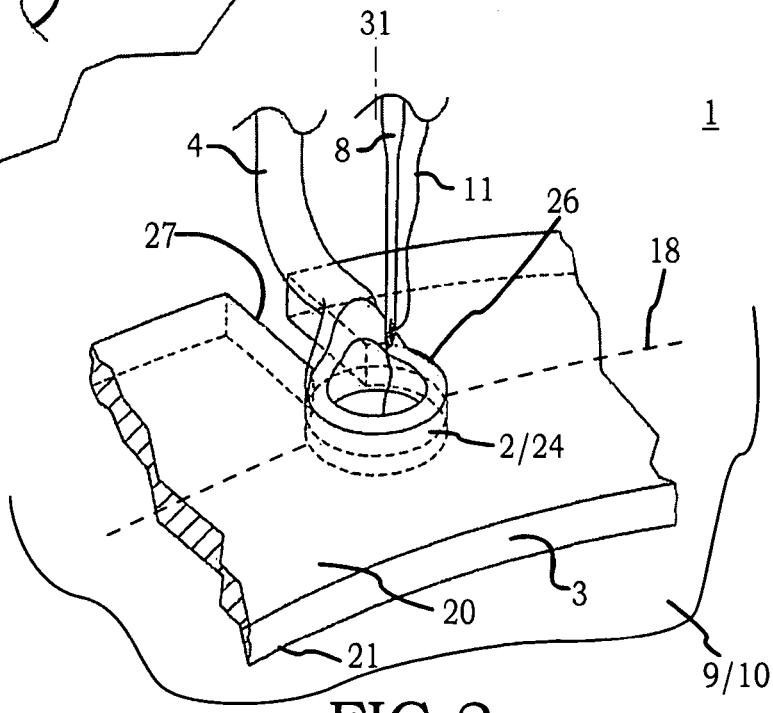
FIG. 2 is an enlargement of a portion of FIG. 1 showing engagement of the particular embodiment of the sewing head navigator shown in FIG. 1 with the external surface of the hopping foot.
Figure 4:
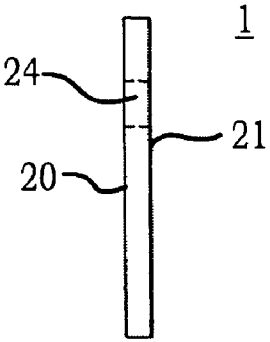
FIG. 4 is a side view of the particular embodiment of the inventive sewing head navigator shown in FIG. 1.

Now referring primarily to FIGS. 1 and 2, a method of using a particular embodiment of a sewing head navigator (1) is shown which can include the step of engaging a pivot element (2) of a navigator body (3) to a hopping foot (4) of a stitching device (5) to allow rotation (6) of the navigator body (3) about the hopping foot (4). The term "stitching device" means a machine having a hand guidable arm (7) which travels to locate a hopping foot (4) and a needle (8) in relation to a stitchable material surface (9) of a stitchable material (10) to allow stitched engagement of a thread (11) by movement of the needle (8) through the stitchable material (10), including but not limited to, longarm quilting machines (12). As a non-limiting example, a Pennywinkle, Model No. 1709 available from Pennywinkle Valley Ranch, 1695 Pennywinkle Branch Road, Waverly, Tenn. 37185. The term "stitchable material" means any material which can be stitched using a stitching device (5), including but not limited to, two or more layers of material of a quilt such as a top fabric, a batting or insulating material, and a backing material. The term "sewing head" means the assembly including the hopping foot (4), a needle drive mechanism (13), and a long arm (14) of a stitching device (5).

The inventive method can further include the steps of gripping the navigator body (3) by a pair of hand grippable ends (15)(16) and sufficiently forcibly urging the pair of grippable ends (15)(16) connected to the navigator body (3) to generate travel in the hopping foot (4), and generally the entire sewing head (17), in relation to the stitchable material (10). The inventive method further includes the step of stitchably engaging a thread (11) with the stitchable material (10) to produce one or more stitches (18) in the stitchable material (10).

Again referring generally to FIGS. 1-5, particular embodiments of the navigator body (3) can have a length (19) disposed between a pair of hand grippable ends (15)(16). The navigator body can have a top side (20) and a bottom side (21). The bottom side (21) can be configured to slidely engage with the stitchable material (10) when rotatably coupled to the hopping foot (4). The particular embodiment of the navigator body (3) shown in FIGS. 1-5 has a thickness (22) disposed between said top side (20) and the bottom side (21) of the navigator body (3). The top side (20) and the bottom side (21) can each having a substantially flat surface which terminates in a perimeter edge (23). However, the configuration of the navigator body (3) shown in FIGS. 1-5 is not intended to be limiting but rather illustrative of the numerous and varied configurations of the navigator body (3) which can be pivotally coupled to the hopping foot (4) having a bottom surface then slidely engaged with the stitchable material (10).

The navigator body (3) can be produced from a numerous and wide variety of materials including without limitation: a plastic material such as poly(methyl methacrylate) which can be substantially transparent to allow visualization of the stitchable material (10) through the navigator body (3), acrylic, polystyrene, plolyvinyl chloride, or the like; or a metal material such as aluminum, stainless steel, or the like, which can further be polished or plated; a wood material such as a board material, a laminated wood product, a fiberboard, or the like. The particular example of the navigator body (3) shown in FIGS. 1-5, provides a substantially transparent poly(methyl methacrylate) having a thickness in the range of about three-sixteenths inch and about one-half inch disposed between a substantially flat top side (20) and a substantially flat bottom side (21) disposed in substantially parallel opposition.

Again referring generally to FIGS. 1-5, the pivot element (2) can comprise any constructional form which allows the navigator body (3) to be rotationally coupled to the hopping foot (4) of the stitching device (5). Rotational coupling of the navigator body (3) to the hopping foot (4) by the pivot element (2) allows the navigator body (3) to rotate (6) about the hopping foot (4) which allows forcible urging upon the navigator body (3) to generate travel in the sewing head (17) in a desired direction. Now referring primarily to FIG. 2, as to certain embodiments, the pivot element (2) can be an aperture element (24) which communicates between the substantially flat surface of the bottom side (21) and the substantially flat surface of the top side (20). The aperture element (24) can define an aperture edge (25) configured to engage a part of the external surface (26) of the hopping foot (4). The hopping foot (4) can be insertingly engaged within the aperture element (24). Certain embodiments of the pivot element (2) which take the constructional form of an aperture element (24) can further include a slot element (27) which extends inwardly from the perimeter edge (23) of the navigator body (3) to communicate with the aperture element (24). The slot element (27) can be configured to facilitate location of the hopping foot (4) in the aperture element (24).

Now referring to FIGS. 1 and 3-5, the sewing head navigator (1) can further include a pair of hand grippable ends (15)(16) connected to the navigator body (3). The hand grippable ends (15)(16) can be of any constructional form each grippable by a corresponding one of a pair of hands (28)(29) of an operator (30). Certain embodiments of the pair of hand grippable ends (15)(16) can be integral with the navigator body (3) being produced from the same sheet of plastic material as the navigator body (3) in a single constructional form.

Figure 3:
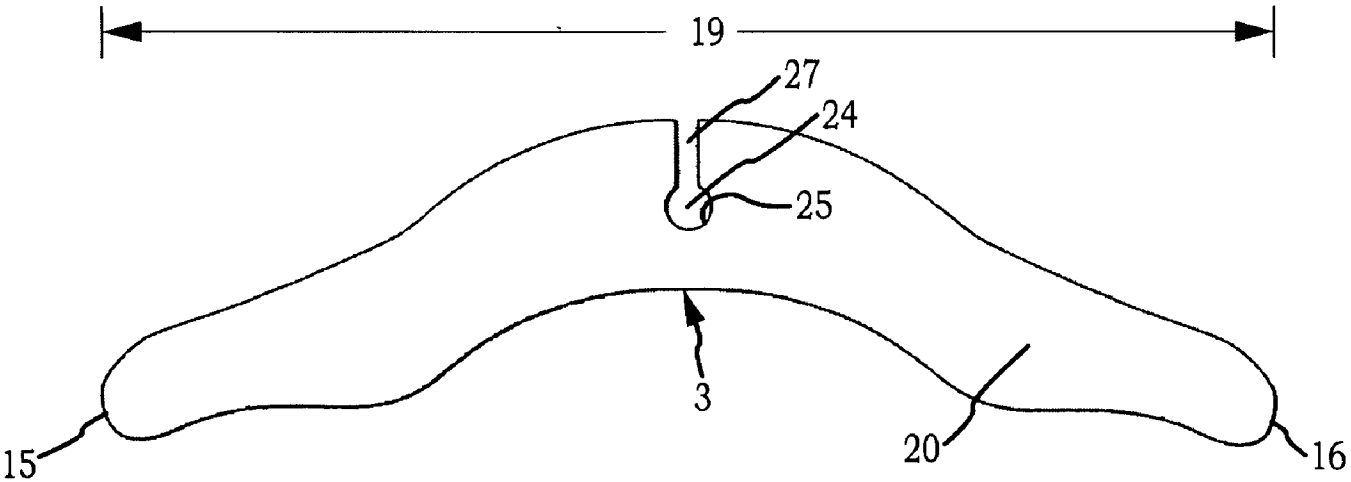
FIG. 3 is top view of the particular embodiment of the inventive sewing head navigator shown in FIG. 1.
Figure 5:
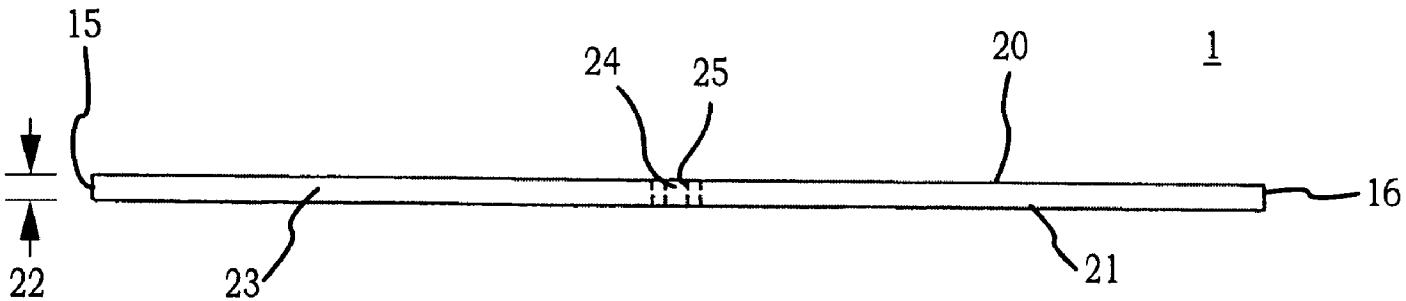
FIG. 5 is an end view of the particular embodiment of the inventive sewing head navigator shown in FIG. 1.

Now referring primarily to FIG. 3, as to certain embodiments of the sewing head navigator (1) the navigator body (3) can be configured to locate the pair of hand grippable ends (15)(16) in greater proximity or closer to the operator (30). While a wide variety of configurations can achieve this result such as an angular configuration having the vertex proximate a pivot axis (31) of the pivot element (2)(see FIG. 2 showing pivot axis (31)), the embodiment of the navigator body (3) shown in FIG. 3 provides a curved navigator body (3) which defines a curved peripheral edge (23) from which the pair of grippable ends (15)(16) extend laterally. The amount of curvature in the navigator body (3) can be varied depending on the application to locate the pair of hand grippable ends (15)(16) closer to the operator (30).

As can be easily understood from the foregoing, the basic concepts of the present invention including the best mode may be embodied in a variety of ways. The invention involves numerous and varied embodiments of a sewing head navigator (1) and methods of making and using such sewing head navigator (1).

As such, the particular embodiments or elements of the invention disclosed by the description or shown in the figures or tables accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of a "sewing head navigator" should be understood to encompass disclosure of the act of "navigating a hopping foot"—whether explicitly discussed or not—and, conversely, were there effectively disclosure of the act of "navigating a sewing head", such a disclosure should be understood to encompass disclosure of a "sewing head navigator" and even a "means for navigating a sewing head." Such alternative terms for each element or step are to be understood to be explicitly included in the description.

In addition, as to each term used it should be understood that unless its utilization in this application is inconsistent with such interpretation, common dictionary definitions should be understood to included in the description for each term as contained in the Random House Webster's Unabridged Dictionary, second edition, each definition hereby incorporated by reference.

Thus, the applicant(s) should be understood to claim at least: i) each of the hopping foot navigators disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification, if any, are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

The claims set forth below are intended to describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

We claim:

1. A sewing head navigator, comprising:

a) a navigator body disposed between a pair of hand grippable ends, said navigator body having a top side and a bottom side defining a perimeter edge, said bottom side configured to slidely engage a stitchable material; and b) a pivot element coupled to said navigator body at a location between said pair of grippable ends, said pivot element comprising an aperture element and a slot element extending inwardly from said perimeter edge to communicate with said aperture element, said slot element configured to allow location of a hopping foot in said aperture element, said aperture element configured to pivotally couple to an external surface of said hopping foot of a stitching device to allow coupled rotation of said pair of hand grippable ends of said navigator body about said hopping foot.

2. A sewing head navigator as described in claim 1, wherein said navigator body has a thickness disposed between said top side and said bottom side of said navigator body, said top side and said bottom side each having a substantially flat surface defining a perimeter edge.

3. A sewing head navigator as described in claim 2, wherein said navigator body has a thickness in a range of about three-sixteenths inch and about one-half inch.

4. A sewing head navigator as described in claim 1, wherein said navigator body disposed between said pair of hand grippable ends comprises a curved navigator body between said pair of hand grippable ends, said curved navigator body defining a curved perimeter edge from which a slot extends inwardly to communicate with an aperture element.

5. A method of using a sewing head navigator, comprising:

a) engaging a pivot element of a navigator body to a hopping foot of a stitching device, said navigator body disposed between a pair of hand grippable ends, said navigator body having a top side and a bottom side defining a perimeter edge, said bottom side configured to slidely engage a stitchable material, said pivot element comprising an aperture element and a slot element extending inwardly from said perimeter edge to communicate with said aperture element, said slot element configured to allow location of a hopping foot in said aperture element, said aperture element configured to pivotally couple to an external surface of a said hopping foot of a stitching device to allow coupled rotation of said pair of hand grippable ends of said navigator body about said hopping foot;

b) gripping said navigator body by said pair of hand grippable ends;

c) sufficiently forcibly urging said pair of grippable ends of said navigator body to generate movement in said hopping foot in relation to said stitchable material.

6. The method of using a sewing head navigator as described in claim 5, further comprising providing said navigator body with a thickness disposed between a top side and a bottom side, said top side and said bottom side each having a substantially flat surface defining a perimeter edge.

7. The method of using a sewing head navigator as described in claim 5, further comprising providing a curved navigator body between said pair of hand grippable ends, said curved navigator body defining a curved perimeter edge from which said slot extends inwardly to communicate with said aperture element.

* * * * *